United States Patent [19]

Mostosi

[11] 4,400,670

[45] Aug. 23, 1983

[54] ELECTRIC SWITCH, MORE PARTICULARLY A CURRENT-LIMITER

[75] Inventor: Angelo Mostosi, Bergamo, Italy

[73] Assignee: SACE S.p.A. Costruzioni Elettromeccaniche, Bergamo, Italy

[21] Appl. No.: 363,929

[22] Filed: Mar. 31, 1982

[30] Foreign Application Priority Data

Apr. 2, 1981 [IT] Italy ..... 20900 A/81

[51] Int. Cl.[3] ..... H01H 77/06

[52] U.S. Cl. ..... 335/6; 335/16; 335/26; 335/189

[58] Field of Search ..... 335/6, 16, 26, 35, 8, 335/9, 10, 21, 22, 189, 190, 191; 337/70

[56] References Cited

U.S. PATENT DOCUMENTS

| | | | |
|---|---|---|---|
| 2,754,389 | 7/1956 | Yarrick | 335/10 |
| 3,808,386 | 4/1974 | Strobel | 335/191 |
| 3,851,284 | 11/1974 | Yoshino et al. | 335/190 |
| 4,220,936 | 9/1980 | Powell | 335/26 |

*Primary Examiner*—Harold Broome
*Attorney, Agent, or Firm*—Diller, Ramik & Wight

[57] ABSTRACT

An electric switch, more particularly a current-limiter, to be actuated by a control pin which indicates the OFF or the ON condition, and which can be opened also by the agency of thermomagnetic tripping mechanisms and by means of a coil. A crank lever is linked to a swinging assembly which is rockably mounted about the pin and to a rocker carrying the rod to actuate the movable contacts. The lever, to be able to permit that the contacts may be closed, must rest on a step of another lever and this resting relationship can be undone either by acting upon the pin, or by means of the tripping mechanisms and the coil. The opening by means of the tripping mechanisms takes place with a kind of "stroke trip" action, the mechanism being automatically reset during opening. The action of the tripping mechanisms is visually displayed and the reclosure of such a switch can be caused dependent from a local intervention by means of a pushbutton.

13 Claims, 16 Drawing Figures

115
107
106
106
105
49
49a
37
58
84
85
86
60
91
92
93
88
100
98
104
101
102
100
14b
62
61
63
14
15
67
14a
69
64
71
70
72
66
65
68

ELECTRIC SWITCH, MORE PARTICULARLY A CURRENT-LIMITER

This invention relates to an electric switch, and more particularly to a current-limiter, and is specifically concerned with the control mechanism for such a switch.

An electric switch contains a mechanism for controlling the movable contacts, whereby it is possible, by a direct manual intervention, or by a remotely controlled action, to bring, selectively, the movable contacts into the OFF or the ON position.

Additionally, thermomagnetic tripping mechanisms are provided, which are capable of automatically effecting the so-called "stroke-trip" that is the contact opening step, in the case of an irregular operation, especially in the case of a current overload, a short-circuit condition and the like. After an action of one of such thermomagnetic tripping mechanisms, that is, after an opening of the contacts by a "stroke-trip" the conventional switches always require a particular local manipulation to reset the stroke-trip device so as to preset the switch for a subsequent closure.

Devices are then provided, as a rule, for displaying, visually and/or electrically, the ON and the OFF conditions.

The control mechanisms for the conventional switches are usually rather bulky and cannot be adapted easily to the several service requirements.

They do not make it possible to concentrate the several mechanical components parts within a reduced and compact enclosure which is separated from the breaking contacts.

No possibility has been provided hitherto for automatically resetting, after an action of the thermomagnetic tripping mechanisms, the conditions in which the switch is preset for being closed (ON).

Moreover, no possibility has been afforded heretofore for differential displaying the conditions of switch-OFF consistently with the different causes of the switch opening.

An object of the present invention is thus to provide an electric switch, more particularly a current-limiter, having a control mechanism which is more compact and is confined within an enclosure, discrete and separated from the thermomagnetic tripping mechanism and from the breaking contacts, so as to become more easily adaptable to various service requirements.

This object is achieved, according to the invention, by an electric switch, more particularly a current-limiter, comprising a control mechanism actuable by means of a control pin mounted for rotation in the switch casing, characterized in that said control pin carries, freely rotatable about its own axis, a swinging assembly, which is coupled to the control pin under the bias of first resilient means in a direction of rotation of the pin and can be disconnected from the pin, against the bias of said first resilient means, in the opposite direction of rotation of the pin, two pulling springs being provided, with means for restraining their maximum compression, the springs being attached by either end to the rocking assembly so as to cause the latter to be rotated in opposite directions, the free end of either spring being secured to the casing and the free end of the other spring being secured to the trunnion of two toggle connecting rods, either of which is connected to an arm of a rocker, and the other to an arm of a bell crank lever, said rocker and said bell crank lever being rotatable about axes parallel to the axis of the control pin, said rocker carrying an abutment for stopping the connecting rod pivoted thereto and carrying, pivoted to the other of its arms a control member for the movable contacts, said other arm of the rocker having a cammed outline intended to coact with a follower carried by said rocking assembly, a lever being provided which is rotatable about an axis parallel to the axis of the control pin under the bias of second resilient means to provide a resting surface for the second arm of said bell crank lever, means being provided for causing said lever to be rotated against the bias of the second resilient means to remove the resting surface for said second arm of the bell crank lever.

The means for causing said lever to be rotated so as to remove the supporting surface to the bell crank lever are connectable to the control pin as the latter is rotated in the direction in which the rocking assembly can be disconnected from the pin in question. Said means can consist of a rotatable tab associated to said bell crank lever and fitted with a tooth inserted into a slot formed through a plate having, at its end away of the slot, a hook capable of coacting, under the bias of third resilient means, with a tooth borne by the control pin, said tooth integral with the control pin being kept into contact with a stop abutment borne by the rocking assembly under the bias of said first resilient means.

The rest lever for the bell crank lever can consist, advantageously enough, of a two-armed lever and, with the second arm of the latter lever, an arm can cooperate, belonging to a second two-armed lever mounted for rotation about an axis parallel to the pivotal axis of the first two-armed lever, upon the second arm of said second two-armed lever the thermomagnetic tripping mechanisms provided in the switch, and possibly a contact-opening coil, being capable of acting.

Such thermomagnetic devices comprise, for each phase, a bimetallic strip which can be bent when a determined "thermic" current flows therethrough and a moving-armature coil adapted to be attracted as a predetermined "magnetic current" flows therethrough. The bimetallic strip and the coil are serially connected into the internal circuit of the switch as closed by the movable and the fixed contacts of each phase.

Now, all the bimetallic strips and all the armatures of the coils (in the case of a triple-pole switch there are three bimetallic strips and three coils) are active upon a tripping system composed of an arbor mounted for rotation in the switch casing and carrying tabs on which the bimetallic strips and the armatures of the coils are active. An additional control tab borne by said arbor is adapted to act upon an arm of a rotatable body which pressed against said control tab by the bias of a spring, a second arm of said body being adapted to be grasped by a spring-biased hammer. This hammer can be active upon a stepped block, which, in its turn and by the intermediary of a rod, may act upon the second arm of said second two-armed lever so as angularly to shift said rest lever and withdraw the stop to said bell crank lever. By so doing, the so called "stroke trip" of the switch can be carried out. This "stroke-trip" is made possible again by resetting during the switch opening operation.

Said rod, which can be shifted by said block, may have, cooperating therewith, a sprung pushbutton so as to latch the rod in its shifted position in which it caused the rotation of said second two-armed lever, thus preventing the first two-armed lever to recoil to the position wherein it afforded a rest to the bell crank lever, thus preventing the switch from being closed (ON). In addition, said rod has a section which, in the shifted position of the rod itself, can be viewed through a front window of the switch to visually display the positive action of the thermomagnetic tripping mechanisms. By so doing, one obtains to latch the switch, so that it cannot be closed (ON) unless said pushbutton is not directly depressed.

A possibility is afforded, nevertheless, to undo this latched condition so as to enable the automatic restoration of the conditions under which the switch can be closed again (ON) after the action of the thermomagnetic tripping mechanisms: in this case, it is only required that said sprung pushbutton be locked in its depressed position, for example by means of a split ring to be applied to the pushbutton shank. Even in such a case, however, the automatic reset of the "stroke-trip" during the opening of the switch, takes place all the same.

The foregoing and other features of the switch according to the invention and the advantages afforded thereby will become more clearly apparent and in more detail from the ensuing description, aided by the accompanying drawings, which illustrate an exemplary embodiment of the switch in question.

IN THE DRAWINGS

Figures 14, 14A, 15:
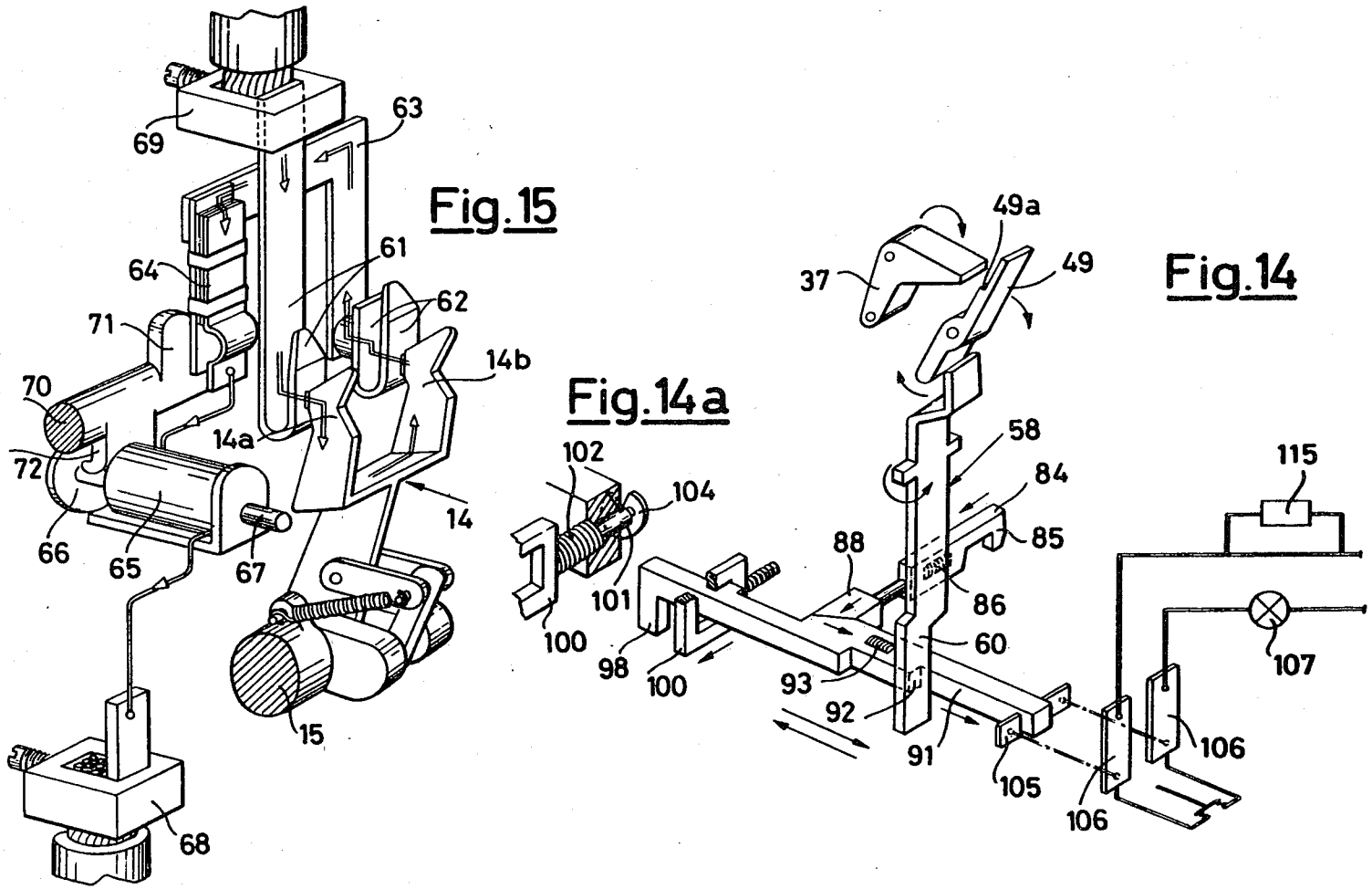

FIGS. from 10 to 15 inclusive diagrammatically show component parts of the control mechanism and of the thermomagnetic tripping mechanism of the switch during different working stages, and FIG. 14*a* is a detail view.

Figure 1:
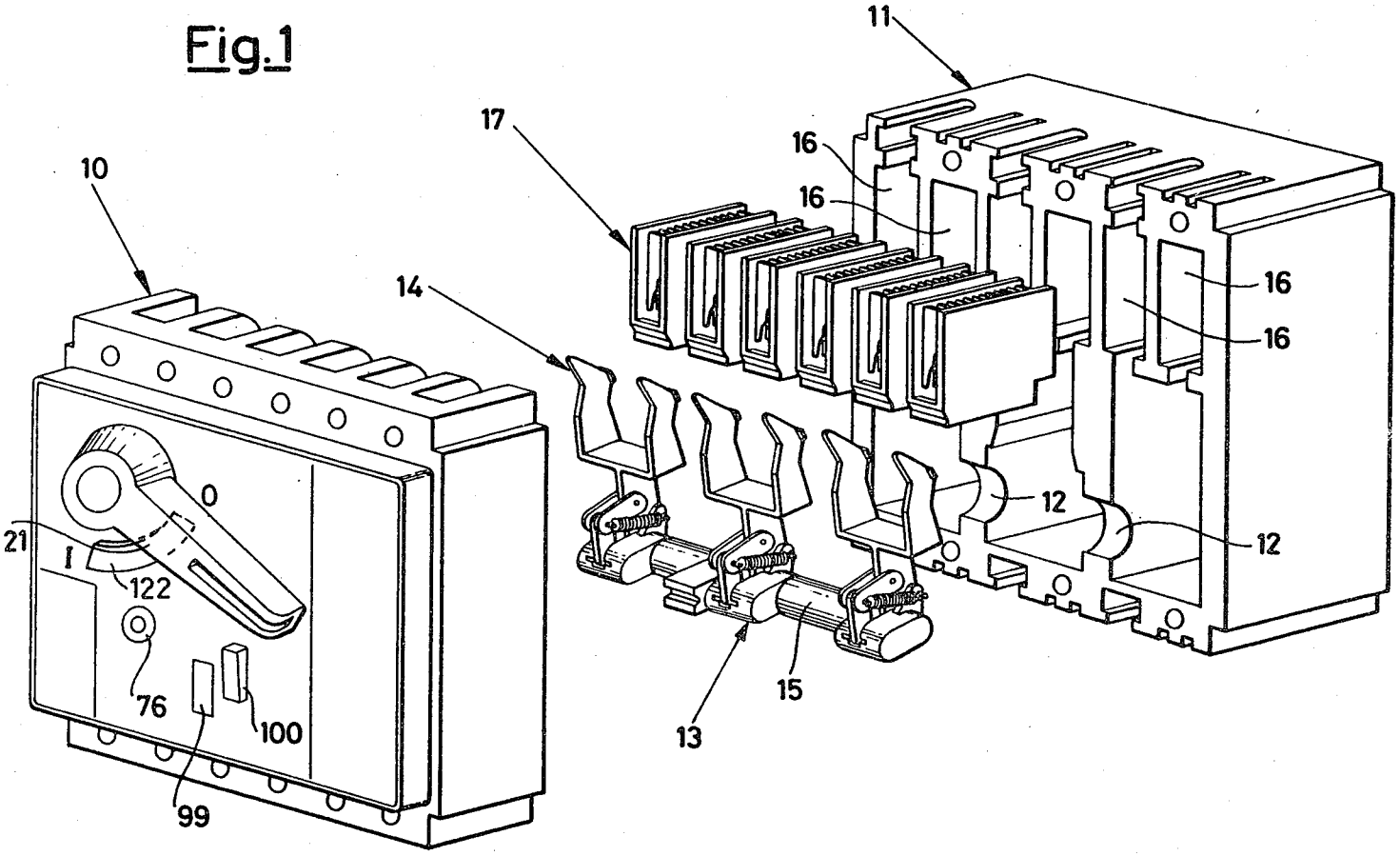
FIG. 1 shows the switch in an exploded perspective view.

FIG. 1 shows that, in the embodiment illustrated herein the switch casing is split into a front portion 10, and a rear portion 11, which can be assembled together and secured to one another by setting members such as screws, not shown in FIG. 1. The two half-casings have, in the matching areas, half-seats, such as 12 that can be seen in FIG. 1 in the rear section 11, for supporting the movable armature 13 of the moving contacts 14.

Inasmuch as a triple-pole switch is illustrated, there are three moving contacts, each of which is a forked contact, that is, a double-throw contact, for every phase.

The moving contacts 14 are mounted with the intermediary of connecting rods and springs on an arbor 15 of the moving element 13 so as to be opened by repulsion the one independently of the others.

As is known, such a mount is such as absolutely to prevent chattering of the moving contacts.

Moreover, the two casing sections, 10 and 11, have, in correspondence with the mating zones, seats 16 to receive blowout compartments 17 for each prong of the forked movable contacts. Also this detail is not a part of the invention and thus will not be described in any details.

The front portion 10 of the casing contains, in the first place, the control mechanism, whereas the rear section 11 houses the thermomagnetic tripping mechanisms and the fixed contacts with the attendant terminals for the connections to the lines.

The control mechanism is actuable by means of a control pin 20 (FIGS. 2 and 3), to which, in the case shown herein, a handle 21 is connected: the latter can be rotated through approximately 90° from a position "O" (open switch,OFF) to a position "I" (closed switch,ON) and vice versa. The handle 21 may have a removable finger 121 (to be locked, if desired, by a lock or the like), which, by coacting with an embossed portion 122 provided on the lid of section 10, may serve to lock up the handle in either of its positions, "O" or "I". It should be noted that, in FIG. 3, the handle 21 has been shown, for the sake of clarity, in a position other than the open position.

The control pin 20, however, can also be acted upon by a remote control mechanism, for example by a solenoid (not shown).

The pin 20 also carries, integral with it, a nose, or tooth 22, and on the pin there is also mounted a swinging assembly 23 which is freely rotatable about the pin axis.

The swinging assembly 23 consists of two identical shaped plates, rigidly connected to one another and carries also a stop dowel 24 for the tooth 22 integral with the pin 20, which is kept to contact with said pin 24 by a spring 25 which is active between the assembly 23 and the tooth 22. Thus the swinging assembly 23 is coupled to the pin 20 in the clockwise rotation sense of said pin (as viewed in FIG. 2), whereas, in the opposite sense of rotation, the pin 20 becomes clear of the swinging assembly 23 and loads the spring 25.

Upon the swinging assembly 23 are active two large extension springs, 26 and 27, which have either of their ends attached to pins, 28 and 29, respectively, which are carried by said assembly so as to have the tendency towards causing the assembly 23 to be swung about the axis of the pin 20, one in a direction, and the other in the opposite direction. The first extension spring 26 is secured with its other end to a pin 30 fixedly secured to the casing 10, whereas the second spring 27, has its other end attached to the linking pin 31 of two connecting rods 32, 33 which make up a toggle system.

It should be noted that, in the interior of the helical springs 26 and 27, spacer bars 34 and 35 are mounted, which define the maximum extent to which the two springs can be compressed.

The connecting rod 32 with its free end is pivoted at 36 to an arm of a bell crank lever 37 linked at 38 to the casing, whereas the connecting rod 33 is pivoted with its free end at 39 to an arm of the rocker 40, the latter being mounted for rotation about a pin 41 of the casing. The axes of the pins 38 and 41 are parallel to the axis of the control pin 20. The rocker 40 carries a stop dowel 42 which restricts the anticlockwise swing of the connecting rod 33, as viewed in FIG. 2.

The second arm of the rocker 40, has on its top portion, a cammed outline 43 intended for cooperating with a follower 44: said follower is carried in an idly rotatable manner by the swinging assembly 23 in a position which is intermediate between the end pins 28, 29 of the springs 26, 27. The second arm of the rocker 40 also carries, pivoted at 45, a rod 46 which has, at its free end, a tooth 47 for engaging a two-tooth sector 49 integral with the arbor 15 which carries the moving contacts 14 (best seen in FIG. 3). Consequently, by lifting the rod 46, the arbor 15 can be rotated in the sense of bringing the moving contacts 14 to their closing position, whereas, if the rod 46 is depressed as shown in FIGS. 2 and 3, the arbor 15 is rotated in the sense of having the moving contacts 14 in their opened position.

Figure 2:
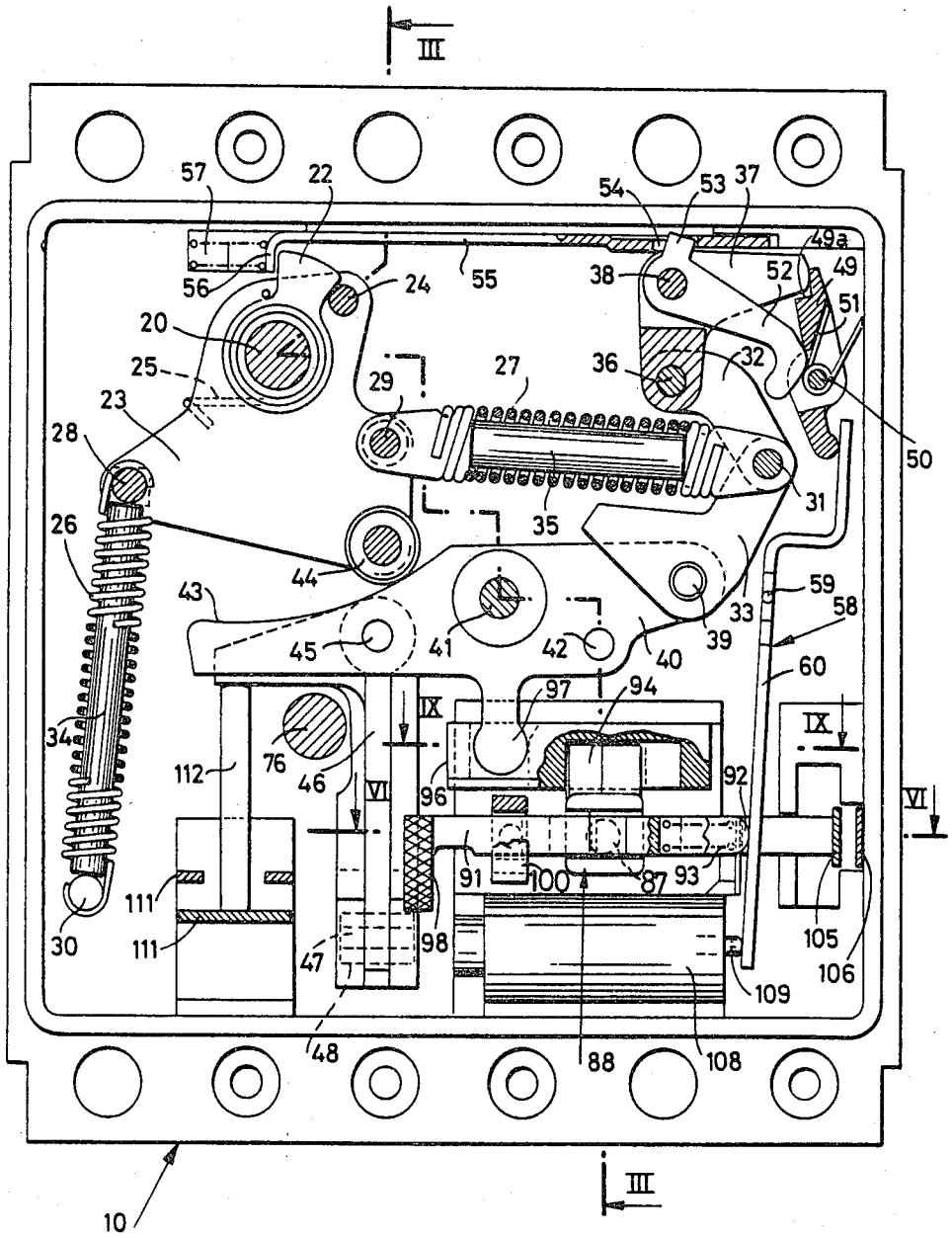
FIG. 2 is a front cross-sectional view, the front lid having been removed, taken along the line II—II of FIG. 3.
Figure 3:
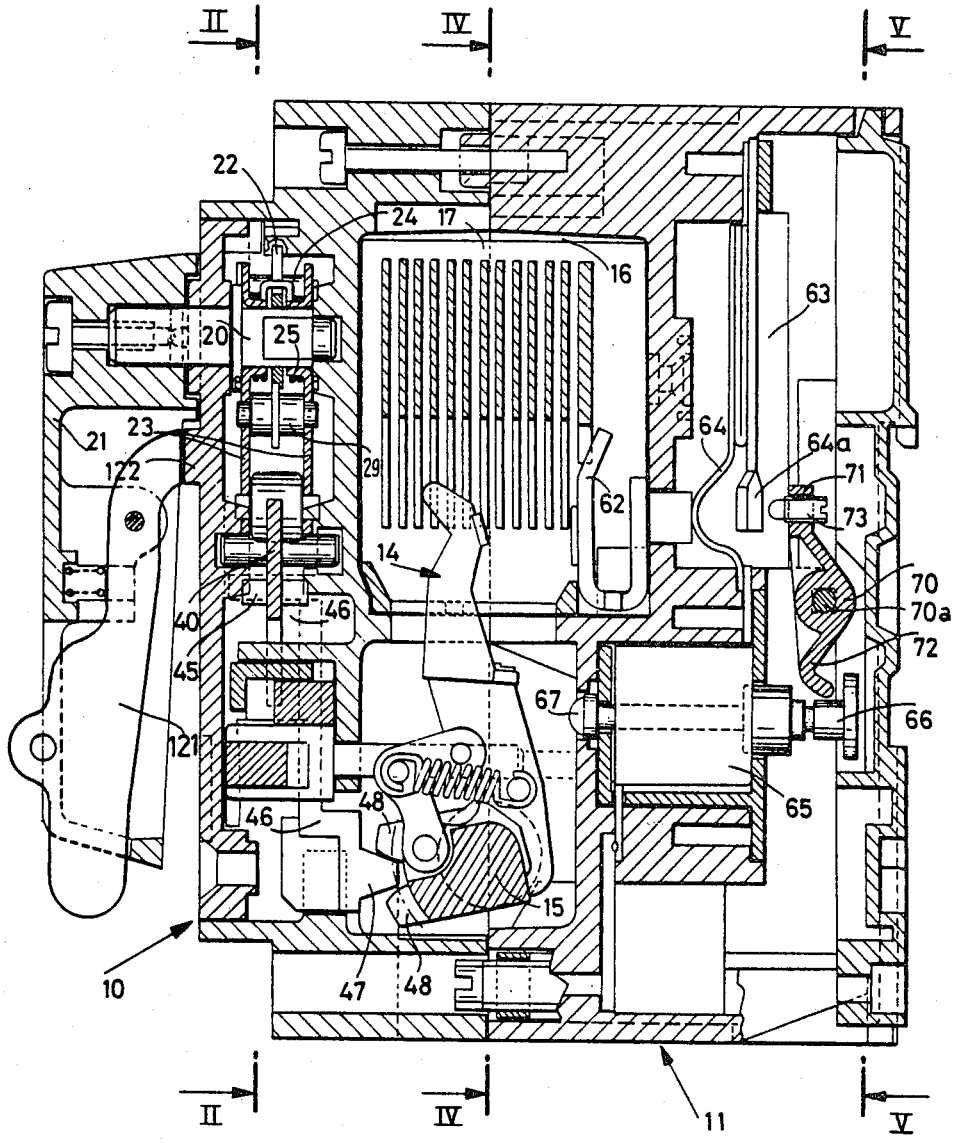
FIG. 3 is a cross-sectional view taken along the line III—III of FIG. 2.

The second arm of the bell crank lever 37 is capable of resting against a step 49*a* of either arm of a first two-armed lever 49 the arms of which are pivoted at 50 to the casing, the lever being biassed by a spring 51 which tends to shift the arm of the lever 49 carrying the step 49*a* towards the bell crank lever 37 (in the anticlockwise direction as viewed in FIG. 2). The spring 51 acts between the casing and the aforesaid rest arm of the lever 49.

The bell crank lever 37 has, associated therewith, a tab 52 mounted for rotation on the pin 38 of the same lever and carrying a tooth 53 inserted in a slot 54 formed through a plate 55, said plate being movable supported in the casing. The end of the plate 55 away of the slot 54 is hook-shaped at 56 and is thrust towards the right as viewed in FIG. 2 by a spring 57. The hooked end 56 can coact with the tooth 22, integral with the control pin 20; as the latter pin is rotated counterclockwise, the tooth 22 drags the plate 55 towards the left so that the tab 52 is rotated counterclockwise. This involves a clockwise rotation of the two-armed lever 49 against the bias of the spring 51, so that the rest arm of lever 49 is separated from the second arm of the bell crank lever 37.

The first two-armed lever 49, and exactly its second arm, can coact with either arm of a second two-armed lever 58, which is mounted for rotation about a pin 59 which is parallel to the pin 50 of the first two-armed lever.

Upon the second arm 60 of said second two-armed lever 58, various devices can be active, to be described hereinafter, for rotating said lever 58 counterclockwise as viewed in FIG. 2 thus originating, with its first arm, a clockwise rotation of the first two-armed lever 49, the resting surface being thus withdrawn for the bell crank lever 37.

At the outset, this effect could be brought about by the thermomagnetic tripping devices.

It has already been said that the switch shown herein is a triple-polar, double-throw current limiter. Thus, it is comprised of three couples of fixed contacts and three couples of moving contacts. A contact couple only will be considered hereinafter, since all the three couples have been constructed in very much the same way.

Figure 4:
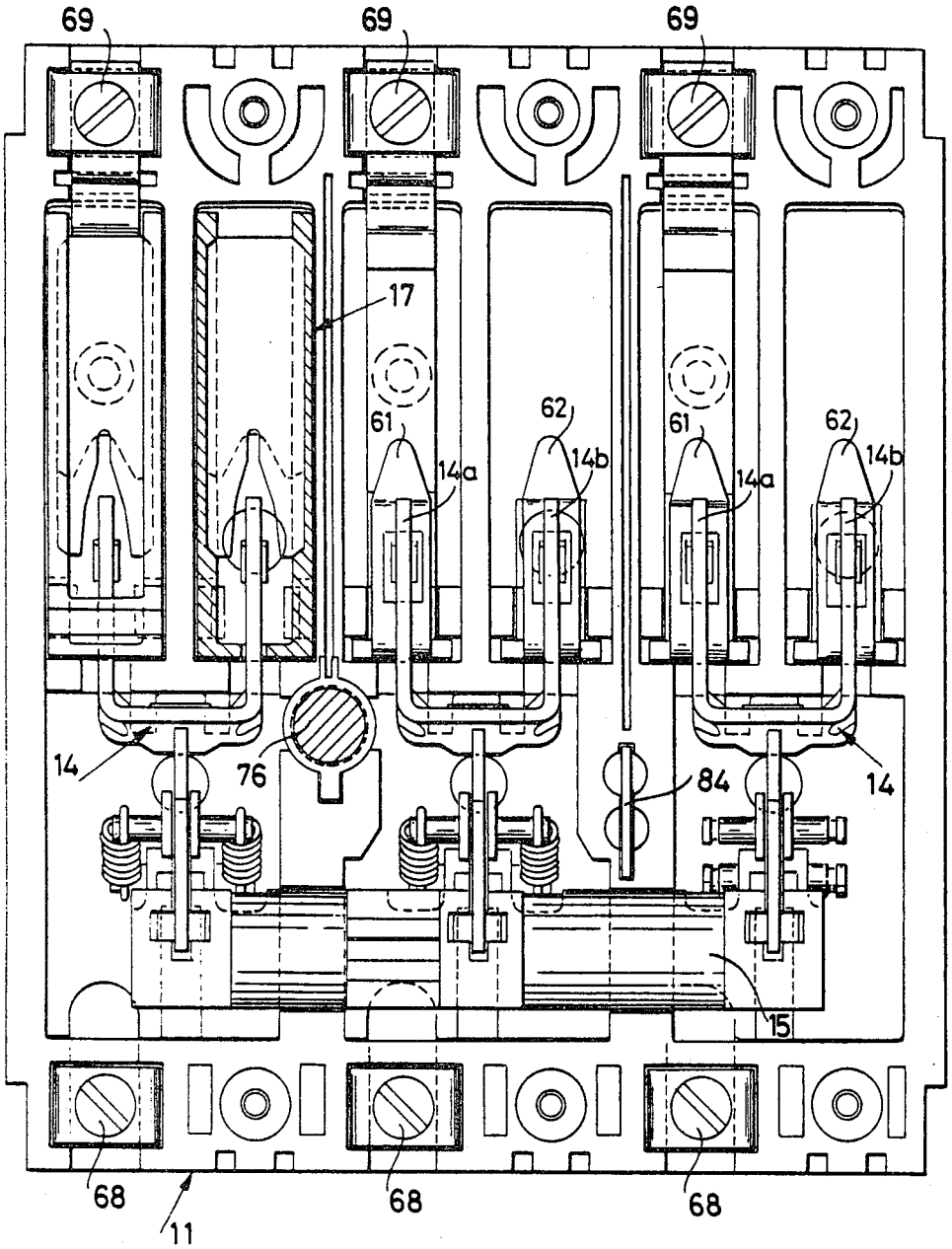
FIGS. 4 and 5 are cross-sectional views taken along the lines IV—IV and V—V, respectively, of FIG. 3.
Figure 5:
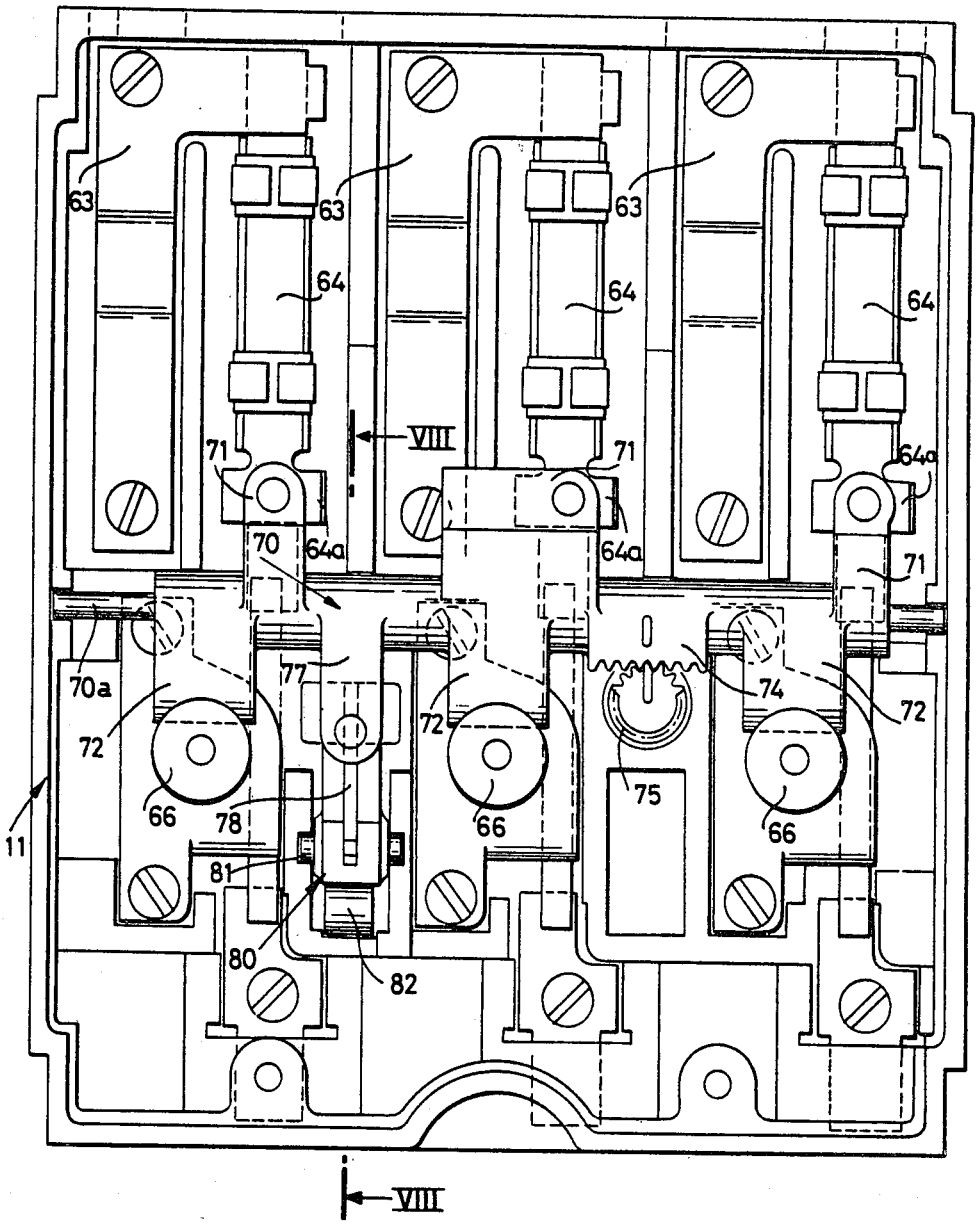

Every couple of moving contacts 14 is comprised of a two-pronged fork, 14*a*, 14*b* (see FIGS. 4 and 15) which cooperate with a fixed main contact 61 and a fixed ancilliary contact 62, respectively. The latter contact is electrically connected through a bridging strap 63 (see also FIGS. 3 and 5), to a bimetallic strip 64 which has an inclined plane portion 64*a*. For each couple of fixed and moving contacts, there are additionally provided a coil 65 with an armature 66 and its stem 67. The coil 65 is electrically connected in serial arrangement between the bimetallic strip 64 and a terminal 68, whereas the main fixed contact 61 is connected to another terminal 69. The direction of the current flow on the internal circuit of the switch is, when the switch is closed (ON), as follows (FIG. 15): from the terminal 69 to the main fixed contact 61, through the two prongs 14*a* and 14*b* of the moving contact to the second ancilliary fixed contact 62, then to the bimetallic strip 64 and through the coil 65 to the second terminal 68. The bimetallic strip 64, which is designed for a certain determined value of the current (called the thermal current) warps and drags its inclined plane 64*a* whenever said value of the current is exceeded. The coil 65 and a spring mounted internally thereof (not shown) are sized for a determined value of the current (called the "magnetic" current), so that the coil 65 shifts the armature 66 and the stem 67 (towards the left, as viewed in FIG. 3) whenever said latter value of the current is exceeded. Devices of this kind are termed thermomagnetic tripping devices and they are capable of causing the trip, that is the release, of the contacts as said values of the current are exceeded.

This action takes place through a tripping device which consists of an arbor 70 mounted for idle rotation about a pin 70*a* secured to the casing, and exactly to the section 11 thereof. The arbor 70 carries a spoke 71 for each bimetallic strip 64 and a spoke 72 for each armature 66 (see FIGS. 3 and 5).

The magnetic calibration (which is determined by the design of the coils 65) is fixed, whereas the thermal calibration is adjustable. The latter is determined by the position of a screw 73 carried by the spoke 71 of the arbor 70 confronting the inclined plane surface 64*a* of the relative bimetallic strip 64. In order to adjust such a thermal calibration, the arbor 70 can be displaced axially in its entirety in either direction. To this purpose the arbor 70 carries a rack 74 (FIG. 5) meshing with a pinion 75 which is integral with an adjustment arbor 76 which is passed through the casing and is frontally accessible (FIG. 1).

Figure 8:
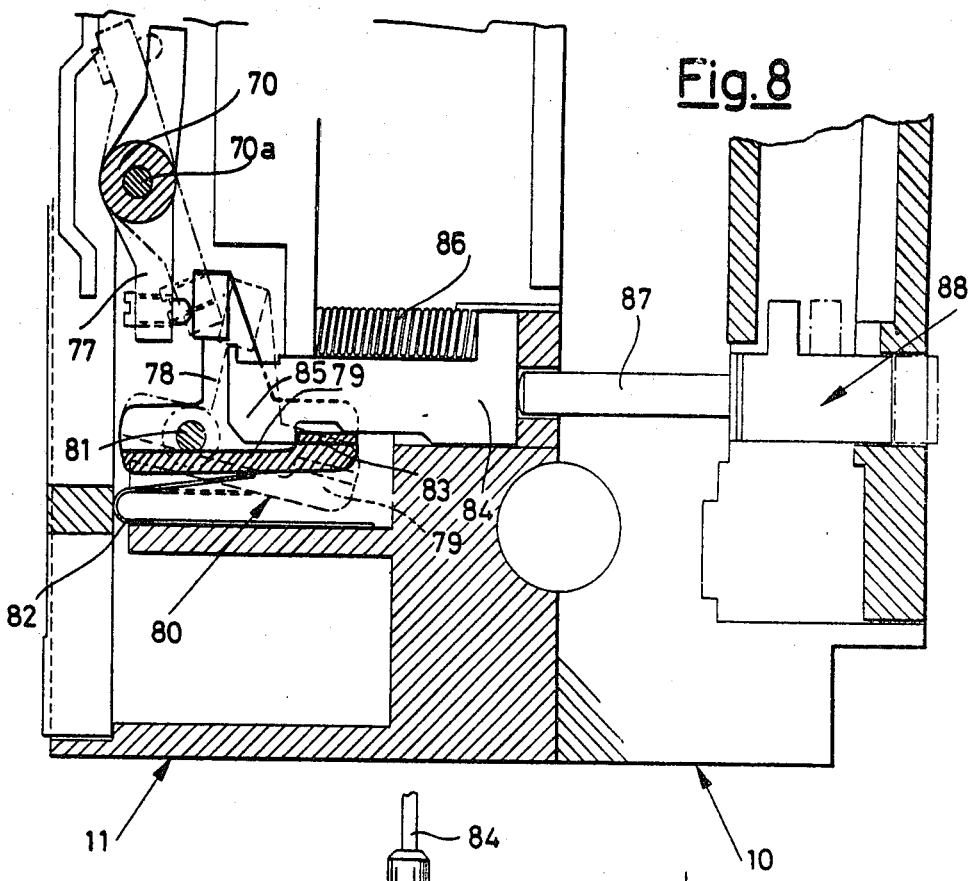
FIG. 8 is a cross-sectional view taken along the line VIII—VIII of FIG. 5.

The arbor 70 carries, in addition, another control tab 77 (FIGS. 5 and 8) which cooperates with an arm 78 of a body 80 which is, in substance, a bell crank lever pivoted at 81 to the section 11 of the casing. A bent leaf spring 82 acting between the casing and the body 80 tends to keep the arm 78 of the body 80 in contact with a plate 84. The second arm 79 of the body 80 has a central slit forming a step 83 and in such slit the plate 84 is partially guided and, with an end hook 85 can be hooked to the step 83. Under the condition in which the plate 84 is hooked to the body 80, a spring 86 which is active between the casing and a protrusion of the plate 84 itself, is loaded. Thus, the plate 84 is a hammer-like member which can be set free by lowering the arm 79 of the body 80 and thus unhooking its hook 85 clear of the step 83 provided thereon. This fact takes place whenever the arbor 70 of the thermomagnetic tripping device is rotated counterclockwise as viewed in FIG. 8, or clockwise as viewed in FIG. 3.

The front side of the plate 84 which is appropriately guided in the casing section 11, contacts the tail portion 87 of a block 88 (see also FIG. 6) which is displaceably mounted in the section 10 of the casing. This block 88 has a first inclined plane 89 which contacts a corresponding inclined plane 90 provided on a shaped rod 91, which, with its step 92, is adapted to act upon the second arm 60 of the two-armed lever 58 (see FIG. 2). The rod 91 is guided in the casing section 10 and is subjected to the bias of a spring 93 which acts within a hollow space of the rod itself against a fixed portion of the casing (see FIGS. 2 and 6) and tends to displace the rod towards the left as viewed in these FIGURES: through the inclined planes 90-89 the tail portion 87 of the block 88 is thrust against the plate 84.

Figure 9:
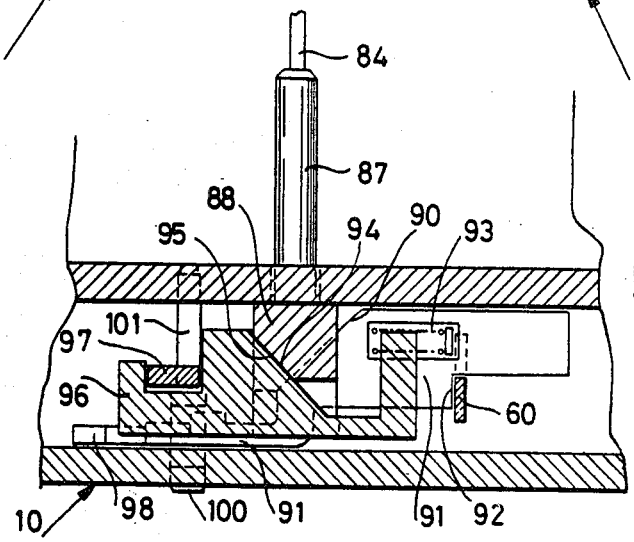
FIG. 9 is a cross-sectional view taken along the line IX—IX of FIG. 2.

The block 88 has a second inclined plane 94 (see FIG. 9) which can cooperate with a correspondingly inclined plane 95 of a slider 96 which is likewise slidably mounted in the casing, and can engage a projection 97 of the rocker 40. Thus, as the rocker 40 is rotated counterclockwise as viewed in FIGS. 2 and 13, its projection 97 shifts towards the right the slider 96, which, through the inclined planes 95-94, originates a shift of the block 88 with its tail portion 87 towards the plate 84.

Figures 6, 7:
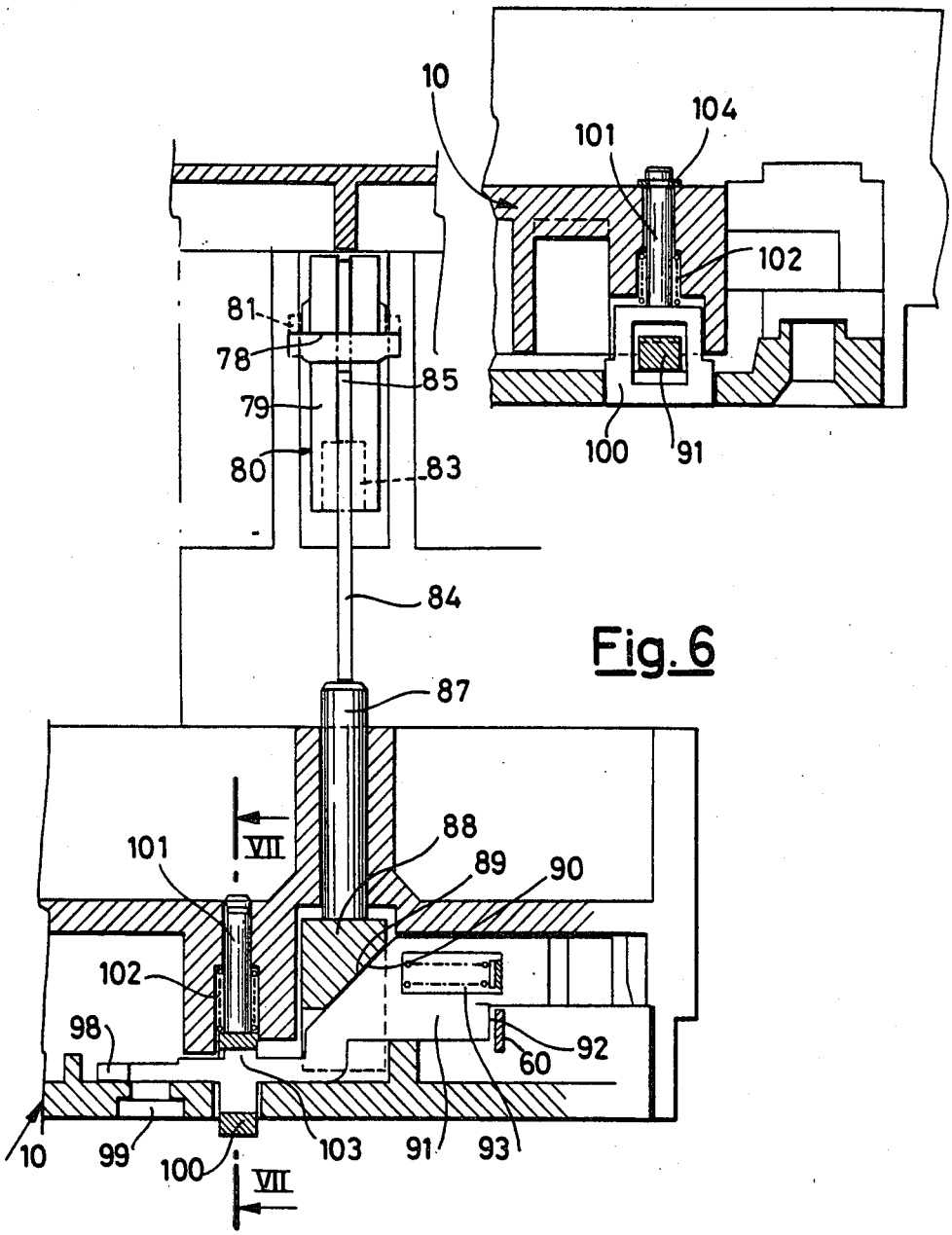
FIG. 6 is a cross-sectional view taken along the line VI—VI of FIG. 2.
FIG. 7 is a cross-sectional view taken along the line VII—VII of FIG. 6.

The shaped rod 91 has, in correspondence with either of its ends a bent portion 98 which can be appropriately color-coded and is adapted to be displayed through a front window 99 (FIGS. 1 and 6) of the switch as the rod 91 is shifted towards the right in FIG. 6 by the action of the block 88.

Means are provided for selectively retaining the shaped rod 91 in such a position shifted towards the right. These means consist of a pushbutton 100 mounted in the casing 10 and having the shape of a rectangular frame through which the rod 91 is passed (see FIG. 7). The pushbutton 100 has, in its rear portion, a stem 101 about which a spring 102 is mounted, which acts between the casing 10 and the pushbutton 100 and tends to shift the latter so that it may frontally emerge from the switch. The rod 91 has a step 103 against which the pushbutton 100 abuts with its rear portion as the rod is in its at rest position (not shifted, see FIG. 6), whereas, as the rod 91 is shifted towards the right, the pushbutton 100 snaps forward and places itself alongside and at the left of the step 103, thus preventing the rod 91 from returning to its at rest position under the bias of the spring 93. In such a case, the rod 91 with its step 92 holds the two-armed lever 58 rotated and likewise the lever 49, thus preventing the bell crank lever 37 to rest on the step 49*a* of the lever 49.

The stem 101 of the pushbutton 100 is guided within the casing 10 and, as the pushbutton is depressed against the bias of the spring 102, it projects for a certain length from the rear of the casing (see FIG. 7). In correspondence with its rear end, the stem 101 has a circular groove in which there can be removably inserted a split ring 104 to latch the pushbutton 100 in its depressed position, so as to prevent the pushbutton from holding the rod 91 latched in its shifted position.

The split ring 104 can be positioned, or removed very easily consistently with the requirements: if no split ring is avilable, in order to close the switch again if it has been opened by the action of the thermomagnetic tripping devices, it is necessary to act at first on the spot and depress the pushbutton 100, thus allowing the rod 91 to be restored to its at rest position.

The end of the rod 91 away of that carrying the bent portion 98, carries a contact 105 (FIG. 2) which, as the rod is shifted towards the right, closes fixed contacts 106 inserted in an auxiliary signalling circuit by a lamp 107 (see FIG. 14).

Figure 12:
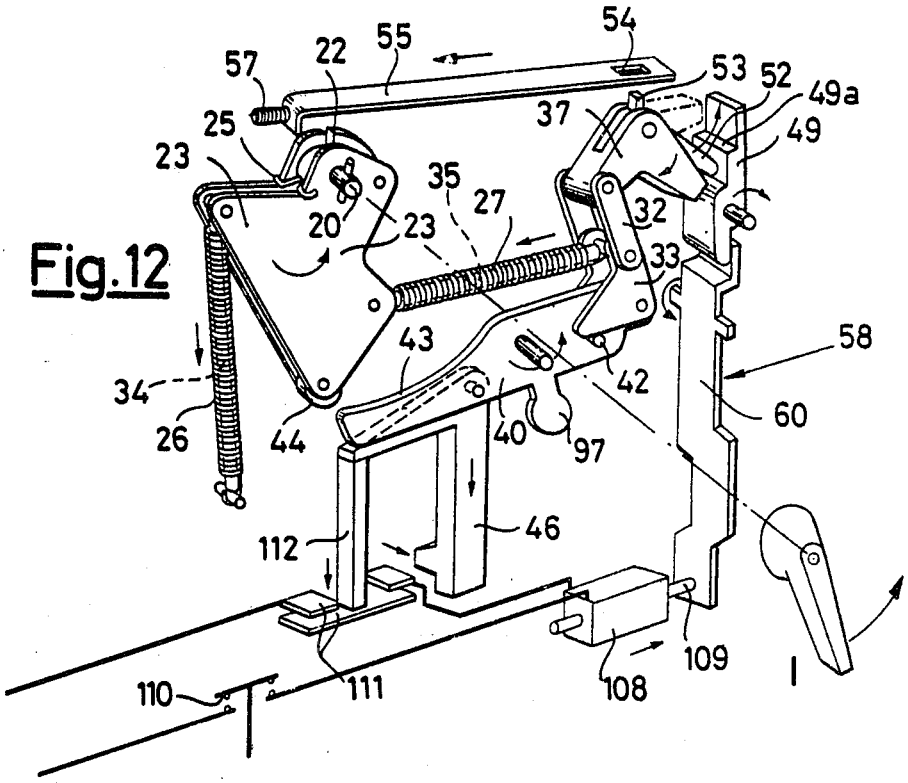

To effect the opening of the switch, also an opening coil 108 is provided (see FIGS. 2 and 12) which is inserted in a second auxiliary circuit and has a movable armature 109 which can act upon the arm 60 of the two-armed lever 58. This second auxiliary circuit comprises a control contact 110 for its closure and also a contact 111 which can be closed by a bar 112 connected to the control rod 46 for the moving contacts 14 of the switch, as the rod 46 is lifted to effect the switch closure. As the rod 46 and the bar 112 connected thereto are, conversely, depressed (as shown in FIG. 2), the contact 111 is open.

The operation of the switch described herein before will now be explained with particular reference to the FIGS. 2 and from 10 to 14 which partially illustrate the several component parts of the control mechanism under different working conditions.

Figure 10:
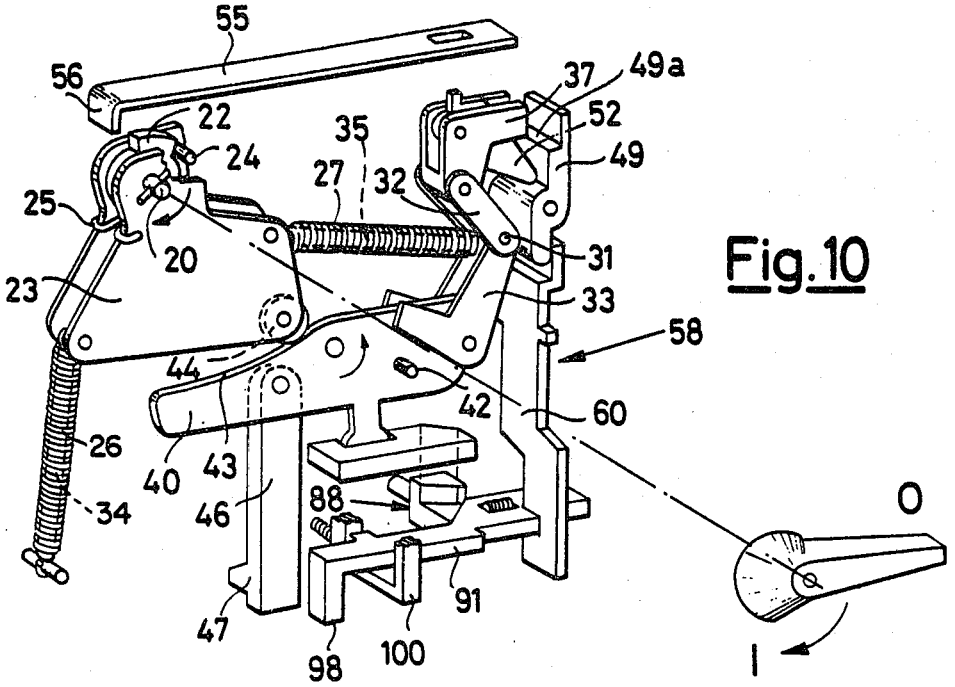
Figure 11:
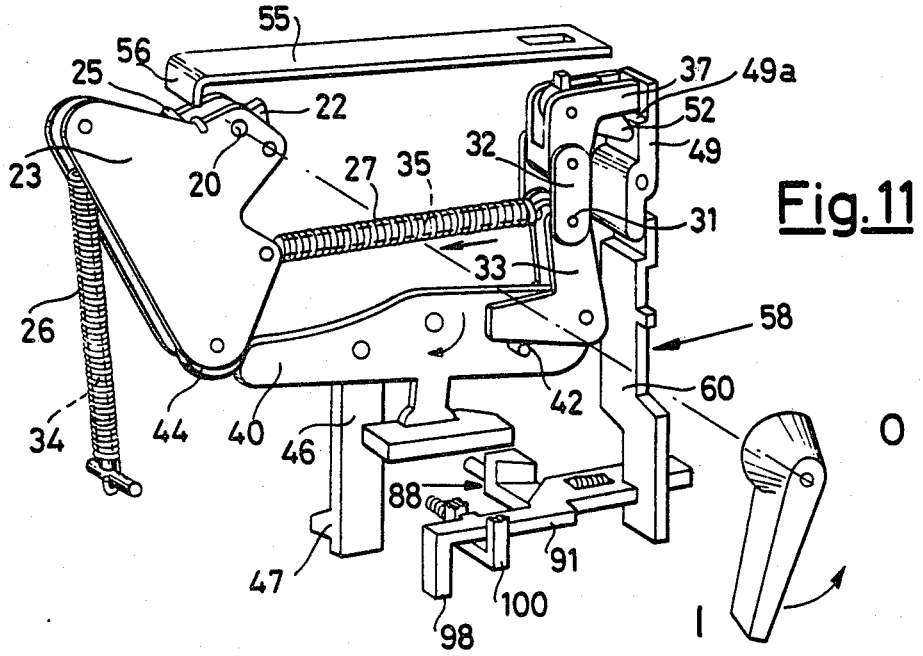

In FIGS. 2 and 10, the component parts are shown in the position in which the switch is open and is ready and preset for being closed. This condition as compared with the closed switch condition (FIG. 11) is characterized in that the rocker 40 is rotated counterclockwise and thus the rod 46 is depressed. The follower 44 rests on the top portion of the cammed section of the rocker 40 which is held in this position by the rocking assembly 23, which is brought to the position shown in the drawing by the extension springs 26 and 27 and is retained at standstill in such position due to the effect of the spacer bar 34 of the spring 26 which is in its position of maximum contraction. The spacer bar 35 of the spring 27 holds pushed towards the right the linking pin 31 of the connecting rods 32 and 33, so that the bell crank lever 37 is kept resting on the step 49*a* of the lever 49 and the rocker 40 is held rotated in the counterclockwise direction. The handle 21 is retained in the "O" position.

If it is desired, now, to effect the switch closure, it is necessary to act upon the control pin 20 by rotating it clockwise. This can be done through the handle 21 by bringing it to the position "I" or by means of a remote control device acting upon said pin 20.

By the rotation in clockwise direction of the pin 20 and the tooth 22 integral therewith and held into contact with the dowel 24 by the spring 25, also the rocking assembly 23 is concurrently swung. By so doing, the extension springs 26 and 27 are tensioned. In a first instant of time, the tension of the spring 27 cannot bring about the extension of the toggle connecting rods 32, 33 because the bell crank lever 37 is resting on the step 49*a* of the lever 49 and because the rocker 40 is prevented from being rotated by the follower 44 sliding over the cam profile 43. At the instant at which the follower 44 clears the rocker 40, the spring 27, tensioned, effects the rotation of the connecting rods 32, 33 until the connecting rod 33 abuts the dowel 42 and, consequently, the rocker 40 is rotated clockwise and lifts, with its second arm the rod 46. The latter, in its turn, causes the rotation of the moving element 13 and the closure of the moving contacts 14 against the fixed contacts 61-62 with the preselected contact pressure. The handle 21, on completion of this step, remains in its position "I" and the component parts of the control mechanism take the position shown in FIG. 11.

Should the switch closure be attempted under short-circuited conditions, at the instance of the contact between the fixed and the moving contacts, the moving contacts would instantaneously restored to the open position by the repulsion due to the "coil effect" of the contacts (which is characteristic of the current limiters) and this independently of the angular position of the arbor 15 which carries the moving contacts 14 (see FIG. 15). This instantaneous reopening of the moving contacts 14 is also assisted by the thrust exerted thereon by the stems 67 of the coils 65 of the magnetic tripping devices which act upon the moving contacts after having previously tripped the device for opening the control, as will be described hereinafter. This takes place even if the handle 21 should be kept in the closed position. At any rate, as the handle is set free, it goes back to the open position.

The switch opening can be caused to occur in various ways: with the control handle 21, by the action of the thermomagnetic tripping devices 64 and 65, or by the action of the opening coil 108.

In the first place, the opening by the handle 21 will be considered.

Starting from the "I" position of the handle 21 (position of FIG. 11), the handle is rotated counterclockwise and drags with it the pin 20 and the tooth 22 integral therewith. The rocking assembly 23 is not allowed, at a first stage, to follow this rotation, because it is held stationary by the rocker 40 which abuts with its end the follower 44. Thus, the pin 20 and the tooth 22 are rotated alone and disconnect themselves from the rocking assembly 23 so that the spring 25 is loaded thereby. This rotation is continued until the tooth 22 gasps the hook 56 of the plate 55 to drag it towards the left (FIG. 12) and the spring 57 is compressed. The plate 55, which, through its slot 54, meshes the tooth 53 of the tag 52 causes now a rotation of the latter about the axis of the pin 38 and the end of the tag 52 acts upon the rest arm of the first two-armed lever 49 and causes the clockwise rotation thereof against the bias of the spring 51. By so doing, the bell crank lever 37 does no longer rest on the step 49*a* of the lever 49 and the bell crank lever 37 can be rotated clockwise by the tractive bias of the spring 27 (which is tensioned during the closure stage of the switch) said bias being transferred by the linkage 32-33. Concurrently, still by virtue of the tractive bias of the spring 27 as transferred by the connecting rods 32 and 33, the rocker 40 is caused to be rotated counterclockwise.

Such a rotation of the rocker 40 brings about, at the outset, the depression of the control rod 46 of the moving element 13 with an attendant rotation of the arbor 15 which brings the moving contacts into the open position. The open motion for the contacts is also encouraged by the contact pressure. Thus the switch is opened. In the second place, the rocker 40, by lowering its left arm, clears the stop for the rocking assembly 23 and the latter, under the bias of the springs 26, 27 and 25, is rotated countrclockwise so as that the follower 44 is brought back onto the cam profile 43 of the rocker 40 again. As the spring 27 reaches its condition of maximum compression as brought about by the spacing bar 35, said spacing member acts like a connecting rod and, upon the farther counterclockwise rotation of the assembly 23 under the bias of the spring 26, the linking pin 31 of the connecting rods 32, 33 is thrust towards the right, the connecting rods 32 and 33 are rotated and, while 33 becomes clear of the dowel 42, the other connecting rod 32 rotates the bell crank lever 37 counterclockwise, so that the rest lever 49 urged by the spring 51 is allowed to creep with its step 49*a* under 37, whereby the condition wherein the bell crank lever 37 may rest on the step 49*a* is restored. The final position of the rocking assembly 23 is determined by the spacing bar 34 associated with the spring 26, which prevents any further compression of such spring. Finally, the control members are all in the positions shown in FIG. 10 once more. The "O" position of the handle 21 indicates the open switch position.

It should be noted that the closing and the opening operations for the switch via the control pin 20 under the normal operational conditions have no influence at all on all the component parts which are connected with the tripping mechanism, such as the second two-armed lever 58 (which is connected only dynamically to the first two-armed lever 49), the shaped rod 91, and the tripping device (plate 84, block 88). As a matter of fact, also the slider 96 urged by the projection 97 of the rocker 40 goes along idle runs under such conditions.

Considering now the switch opening as caused by the action of the thermomagnetic tripping mechanisms, the following can be seen.

Figure 13:
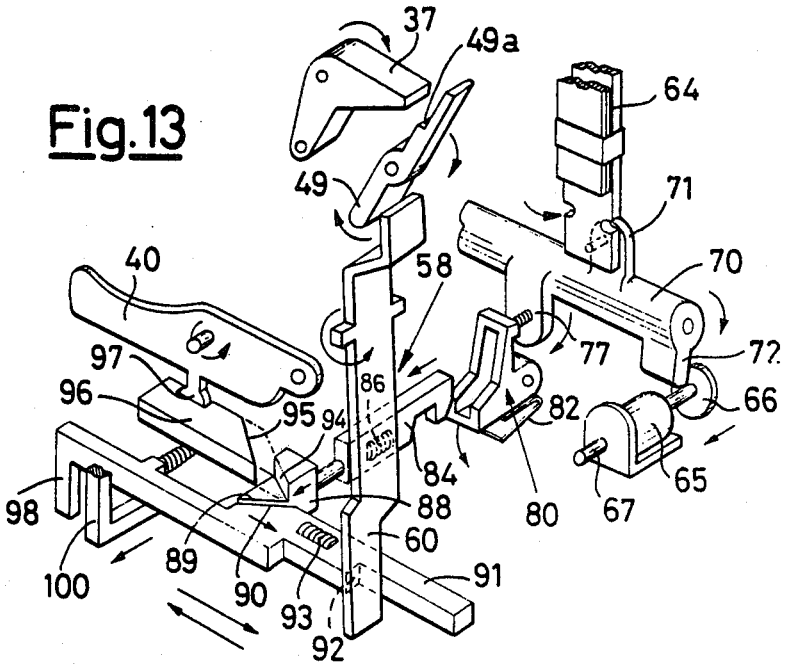

As outlined above, the action of anyone of such mechanisms has, as its result, a clockwise rotation, as viewed in FIG. 13, of the arbor 70 and such a rotation, through the control tab 77, causes the rotation of the body 80 against the bias of the leaf spring 82. Thus the hook 85 of the plate 84 is cleared so that the latter, biased by the spring 86, snaps forward and causes the advance of the block 88 also. The latter block, with its inclined plate 89, pushes the inclined plane 90 of the rod 91 to shift it towards the right in such a way that its step 92, by acting upon the arm 60 of the second two-armed lever 58 causes the latter lever to be rotated counterclockwise, so that, through the first arm of the lever 58, also the lever 49 is rotated (but clockwise) and withdraw the resting step 49*a* from the bell crank lever 37. By so doing, the switch is opened just in the same way as it has been described for the opening with the handle 21 which is brought to the "O" position, that which indicates the open switch position (OFF).

Differently from the manipulation with the handle 21, in the case in point the stroke-trip device has entered action but, in the opening stage of the switch all the starting conditions of the stroke trip device are automatically restored without any necessity for additional operations.

In the first place, it should be noted that, by opening the switch, all the causes which had originated the rotation of the arbor 70 are removed, so that 70 is now free to resume its starting angular position under the bias of the spring 92 via the body 80 on its tag 77.

Secondly, the counterclockwise rotation of the rocker 40 causes by the projection 97 the shift towards the right of the slider 96, which, in its turn, with its inclined plane 95 acting upon the inclined plane 94 of the block 88 pushed the latter backward and concurrently therewith also the plate 84 is pushed back, so that the spring 86 is compressed and the hook 85 of the plate 84 can now grasp the step 83 of the body 80.

By so doing, the stroke-trip device, and particularly the plate 84, is reset automatically once again.

In addition to the manipulation on the control pin 20 or the self-action of the thermomagnetic tripping mechanisms, the switch can also be opened, as outlined above, by the action of the opening coil 108 (FIG. 12) which can be controlled, for example from a remote location, by closing the contact 110.

The auxiliary circuit in which the coil 108 is inserted can be closed because the contact 111 has been closed by the bar 112 as the switch has been closed. As the auxiliary circuit is closed, the coil 108 is energized and this fact originates the shift of the armature 109 of the coil towards the right, thus causing the rotation of the second two-armed lever so that the switch is opened just as described hereinabove. The coil 108 is de-energized by depressing the bar 112 so that the contact 111 is opened. It should be noted that such an opening operation does not influence, in the slightest, the position of the stroke-trip device.

The switch made according to the invention, moreover, provides a visual and/or electric special display of the condition in which the opening has taken place by the action of the thermomagnetic tripping mechanisms, and this, exclusively, in the case that this kind of action only has taken place, and not in the case of switch opening by manipulation of the control pin 20, or by action of the opening coil 108, the possibility being furthermore afforded of activating a block to prevent the switch closing operation after the action of the thermomagnetic tripping devices without requiring any previous intervention on the spot. In order that this possibility may be better appreciated, reference will now be had to FIG. 14.

It has been said that the action of the thermomagnetic tripping devices causes the stroke trip and thus the shift towards the right of the shaped rod 91.

Let the condition be considered, at the outset, in which the sprung pushbutton 100 is not fitted with the split ring 104, so that it is not held in the depressed position.

Under these conditions the rod 91, after having been shifted towards the right (that, as outlined above, opens the switch), remains latched in the so shifted position by the pushbutton 100: the latter, in fact, biassed by its spring 102, is arranged with its rear end to the left besides the step 103 of the rod 91. As a result, the bent portion 98, which may be color-coded with advantage, is displayed through the window 99 and signals the action taken by the tripping mechanisms and the block of the switch. An electric display of the same conditions is given by the lamp 107 the circuit of which has been closed by the rod 91 by means of the contacts 105 and 106.

If the rod 91 is latched in its shifted position, the switch cannot be closed because the step 92 of the rod 91 holds the arm 60 of the level 58 rotated and this, in its turn, holds the lever 49 rotated, so that the bell crank lever 37 cannot find any rest surface on the step 49*a* of lever 49, a condition which is essential to be able to close the switch.

The closure of the switch is possible only after an intervention of an attendant on the spot, by depressing the pushbutton 100, that which clears the rod 91 so that such rod, under the bias of the spring 93 is brought to its starting position back again. By so doing, also the visual display drops (the colored portion 98 of the rod 91 vanishes from the window 99) and the same is true of the electric display (the lamp 107 goes out).

The two-armed levers 58 and 49 are permitted to resume their normal positions and afford a rest to the bell crank lever 37 so that the switch can be closed once again.

It is possible, however, to dispense with blocking the switch and, if so desired, it suffers to deactivate and latch the pushbutton 100 by applying to the end of its stem 101 the split ring 104, as depicted in FIG. 14*a*. By so doing, the pushbutton 100, after a shift of the rod 91 in the manner explained hereinbefore, does no longer hold the rod in its shifted position, but the rod is allowed to resume its starting position under the bias of the spring 93 once that the action of the stroke trip mechanism is over. The stroke trip mechanism is reset and the switch can also be closed because the lever 58 and 49 resume the position in which the lever 49 affords a resting surface to the bell crank lever 37.

In this case, the visual and electric displays of the action of the termomagnetic tripping mechanisms would be transitional only, because the portion 98 of the rod 91 vanishes again and the lamp 107, which had been turned on by the short current pulse it received, goes out as the contact 105 and 106 are reopened. In order that a permanent display may be obtained also in such a case, a shutter relay 115 (FIG. 14) can be inserted in the circuit which contains the lamp 107.

The advantages afforded by the switch made according to the invention can be summarized as follows:

(a) The entire control mechanism is condensed into a comparatively small and compact compartment which is separated from the cutoff contacts and from the thermomagnetic tripping devices;

(b) Even in the case of the tripping mechanisms entering action, the automatic reset of the stroke trip device takes place in any case during the switch opening stroke without any reset manipulation being necessary;

(c) The control handle, with its position, signals in every case and accurately the positions of the contacts; even if the closure is carried out under short-circuit conditions, the handle returns to its open position, whereas, in the case in which the contacts are in mutual touch, the handle displays the closed position irrespective of the fact that the opening manipulation is made with the handle or the opening is brought about by the action of the thermomagnetic tripping devices or the action of the opening coil;

(d) When the moving element is in the open position no closure can take place, not even a transitional one, of the contacts due to chattering or bumps since the follower of the rocking assembly keeps the rocker in a position in which the control rod of the moving element cannot be raised;

(e) The possible remote control arrangement requires a single coil for the closure, whereas no second solenoid for resetting is necessary because the resetting, as explained hereinbefore, takes place automatically during reopening;

(f) The block of the switch can be optionally provided in order to make it compulsory, in the case of the action of the thermomagnetic tripping devices, to act manually on the switch to be allowed to close it; as an alternative, also in such a case, the automatic switch reset to the conditions in which it can be opened, can be provided, and (g) A differential display is available for signalling the action taken by the thermomagnetic tripping devices; said display can be either of the permanent or the impulsive type, whereas no display is effected when opening is made by the handle or by the opening coil; the impulsive type display may be made permanent by employing a shutter relay.

I claim:

1. An electric switch, more particularly a current limiter, having fixed and movable contacts and a control mechanism actuated by a control pin mounted for rotation in the switch casing, characterized in that said control pin carries for free rotation about its axis a rocking assembly, which is coupled with the control pin under the bias of first resilient means in a direction of rotation of said pin, and can be cleared of the pin against the bias of said first resilient means, in the opposite direction of rotation of the pin, in that there are provided two extension springs, with means to limit their maximum compression and attached at either end to the rocking assembly so as to tend to have it rotated in opposite directions, the free end of one of said spring being attached to the switch casing and that of the second spring to the linking pin of two toggle connecting rods, one of which is pivoted to an arm of a rocker and the other to an arm of a bell crank lever, said rocker and said bell crank lever being rotatable about axes, parallel to the axis of the control pin, in that said rocker carries a stop for the connecting rod pivoted thereto and carries pivoted to its other arm a control member for the moving contacts, said other arm of the rocker having a cammed profile with which a follower is intended to coact, as carried by said rocking assembly, in that a lever is provided which is rotatable about an axis parallel to the axis of the control pin under the bias of second resilient means to provide a resting surface to the second arm of said bell crank lever, and in that means are provided to rotate said lever against the bias of the second resilient means for withdrawing the rest surface to said second arm of the bell crank lever.

2. A switch according to claim 1, characterized in that said means for rotating said lever so as to withdraw the resting surface to the bell crank lever can be connected to the control pin as the latter is rotated in the sense in which the rocking assembly can be cleared of same pin.

3. A switch according to claim 2, characterized in that said means consists of a tab which is rotatable and associated to the bell crank lever and fitted with a tooth inserted through a slot of a plate fitted, at the end away of the slot, with a hook adapted to cooperate under the bias of third resilient means with a tooth carried by the control pin, said tooth integral with the control pin being held in contact with a stop borne by the rocking assembly under the action of said first resilient means.

4. A switch according to claim 1, characterized in that the lever for the bell crank lever is a two-armed lever and in that there is provided a second two-armed lever adapted to cooperate with either arm with the second arm of the first two-armed lever, whereas thermomagnetic tripping devices are adapted to act upon its second arm.

5. A switch according to claim 4, characterized in that the thermomagnetic tripping devices act upon tags projecting from an arbor which is rotatable and which additionally has a control tag, in that an arm of a rotatable body is kept in contact with the latter tag under the bias of a spring, a preloaded hammer member being hookable to a second arm of said body, and in that said hammer member, through a block having two inclined planes and a shaped rod, is adapted to act upon the second arm of said second two-armed lever.

6. A switch according to claim 5, characterized in that said shaped rod is subjected to the bias of a spring tending to keep it in contact by an inclined plane of the rod, with either inclined plane of said block.

7. A switch according to claim 5, characterized in that upon a second inclined plane of said block a slider can act, which is moved by a projection of said rocker to cause, after a tripping of the hammer member by the action of the thermomagnetic tripping devices, the reset of said hammer member by hooking it to said rotatable body again.

8. A switch according to claim 6, characterized in that a spring-biased pushbutton is provided which is adapted to cooperate with a step of said shaped rod to hold it in the shifted position taken thereby as a result of the action of the thermomagnetic tripping devices.

9. A switch according to claim 8, characterized in that said spring-biased pushbutton can have applied thereto means for latching it so as to prevent its coupling with the step of the shaped rod.

10. A switch according to claim 8, characterized in that said shaped rod is fitted with a portion which in the shifted position of said rod can be viewed through a window of the switch.

11. A switch according to claim 5, characterized in that said shaped rod carries a contact adapted to close an auxiliary circuit in which a pilot lamp is inserted.

12. A switch according to claim 11, characterized in that said auxiliary circuit contains a shutter relay.

13. A switch according to claim 4, characterized in that an opening coil is provided, to be inserted in an auxiliary circuit and adapted to act by means of a movable armature upon the second arm of said two-armed lever, said auxiliary circuit being capable of being closed by an external control contact, said auxiliary circuit further having inserted therein a contact which can be actuated by the control member for the moving contacts of the switch so as to close said circuit when the contacts of the switch are closed.

* * * * *